United States Patent [19]

Paramanathan

[11] Patent Number: 4,990,223

[45] Date of Patent: Feb. 5, 1991

[54] METHOD AND APPARATUS FOR THE ELECTROLYTIC COATING OF ONE SIDE OF A MOVING METAL STRIP

[75] Inventor: Bala K. Paramanathan, Heemstede, Netherlands

[73] Assignee: Hoogovens Groep B.V., IJmuiden, Netherlands

[21] Appl. No.: 407,732

[22] Filed: Sep. 15, 1989

[30] Foreign Application Priority Data

Sep. 23, 1988 [NL] Netherlands ..... 8802353

[51] Int. Cl.[5] ..... C25D 7/06; C25D 17/00

[52] U.S. Cl. ..... 204/28; 204/206

[58] Field of Search ..... 204/28, 206

[56] References Cited

U.S. PATENT DOCUMENTS 4,500,400 2/1985 Komoda ..... 204/206

FOREIGN PATENT DOCUMENTS 0282980 9/1988 European Pat. Off. .

OTHER PUBLICATIONS

Patent Abstracts of Japan, vol. 11, No. 315 (C-451)(2762) Oct. 14, 1987 S. Murakami, "Electroplating Device for Metallic Strip".

*Primary Examiner*—T. M. Tufariello

*Attorney, Agent, or Firm*—Stevens, Davis, Miller & Mosher

[57] ABSTRACT

In electrolytic coating of one side of a moving metal strip, the strip as cathode is in contact with a rotating roller and an insoluble anode is concentric with the roller at a distance from the strip so that a slot is formed in which the electrolytic coating takes place. The electrolyte flows through the slot at a sufficient average velocity that turbulent flow occurs and is fed from a nozzle into the slot with a tangential component opposite to the direction of travel of the strip at the end of the slot at which the strip axis. The conformation of the nozzle is substantially uniform across the whole width of the strip and the electrolyte is fed into the slot at a velocity that nowhere varies more than 10% from the said average velocity of the electrolyte.

9 Claims, 4 Drawing Sheets

METHOD AND APPARATUS FOR THE ELECTROLYTIC COATING OF ONE SIDE OF A MOVING METAL STRIP

BACKGROUND OF THE PRESENT INVENTION

1. Field of the Invention

The invention relates to a method and apparatus for the electrolytic coating of one side of a moving metal strip.

2. Description of the Prior Art

EP-A-1257O7 describes an electrolyte coating method in which the moving metal strip as cathode is in contact with an electrically conductive outer surface of a rotating cathode roller and an insoluble anode is positioned concentrically with the roller over a part of the circumference of the roller at a distance from the strip. A slot is thus formed over that circumference part into which electrolyte is fed and in which the coating takes place, the electrolyte flowing generally through the gap at an average velocity such that turbulent flow occurs. The electrolyte is fed as a fluid jet into the gap at one of its ends with a tangential component relative to the path of the strip. This method of electrolyte coating strip has a number of advantages compared with other known methods.

EP-A-28298O discloses a similar apparatus, in which the electrolyte is fed in at the strip exit end of the slot.

Where the current is fed to the strip via the roller, it does not need to be led with resistance losses along the strip, as is the case with flat, vertical or horizontal cells, but rather it may be transferred directly from the cathode roller to the strip; this advantage is of particular importance for thin strips such as for example when plating tinplate with a thickness of for example 0.17 mm. A second advantage is that (in contrast with flat, vertical or horizontal cells where the strip is led between two anodes positioned at a distance from the strip) the path of the strip is fixed, because the strip is taken around the cathode roller. This means that the gap between the strip and the anode varies less during coating, especially if the anode is an insoluble one, thereby achieving a more uniform thickness of the coating layer.

In spite of the above mentioned advantages it has been found from experiments carried out by the applicant on the method of EP-A-125707 that it has a number of disadvantages. First of all the uniformity of the thickness of the coating layer is not satisfactory across the width of the strip. Secondly, under certain conditions the efficiency of the known method may be very low especially at somewhat higher strip speeds. These disadvantages will be further illustrated below.

SUMMARY OF THE INVENTION

One object of the invention is to provide an improved method and apparatus in which a better uniformity of the thickness of the coating layer may be obtained. Another object of the invention is to create a method which has a high efficiency under any conditions.

In accordance with the invention, by means of a nozzle having a uniform conformation across the width of the strip, the electrolyte is fed into the gap at a velocity that nowhere deviates more than 10% of the said average velocity of the electrolyte in the slot. The electrolyte is fed in at that end of the slots where the strip exits, with a tangential component opposite to the direction of travel of the strip. This arrangement optimises the electrolyte flow conditions into the slot between the strip and the anode, whereby a very uniform thickness of the coating layer across the width of the strip and high efficiency of the coating process is obtained. In addition the pumping energy needed for feeding the electrolyte into the slot can be low.

The average velocity of the electrolyte in the slot is preferably at least 5 m/sec and still more preferably at least 7 m/sec. The advantage of this is that high current densities may be used when coating so that the apparatus used for coating may be compact.

Preferably the nozzle has a slot-shaped outlet mouth which is open substantially uninterruptedly across the width of the strip and is of uniform width across the width of the strip. The nozzle may be a conveying nozzle.

Suitably, the nozzle is supplied from a vessel extending across the width of the strip, which vessel has a large volume relative to the volume of the nozzle and is supplied with electrolyte by means of a plurality of conduits distributed across the width of the strip. In this case, it is preferable that the discharge directions of the conduits are not aligned with the nozzle and that a core body should be fitted in the vessel. Furthermore, the nozzle makes an acute angle $\alpha$ with the tangential direction of the slot, which angle is preferably less than 45°, and still more preferably about 30°.

The feed of the supply vessel for the nozzle through a number of conduits gives reduced yet still considerable variations in velocity in the vessel. By directing the supply flows from the conduits towards a closed side of the vessel, these variations are damped out. For example the feed conduits are positioned at right angles to the outlet opening of the vessel. The velocity variations are also reduced by partially filling the vessel with the core body. In the vessel the flow velocities are relatively low because of the comparatively large volume of the vessel. This means that the velocity variations become proportionately smaller. Also the non-radial velocity components in the vessel are smaller, which means that a uniform quantity distribution occurs across the outlet opening. The velocity variations are further reduced in the nozzle. The electrolyte is also injected into the slot by the nozzle at a small angle. The small angle and the narrowing of the nozzle close to where the electrolyte comes out produce a small under-pressure in the exit opening of the strip thus reducing leakage of the electrolyte through that exit opening. With the method in accordance with the invention and for an 850 mm wide strip, a uniform velocity can be attained which does not deviate more than +6% and −7% from the average velocity.

INTRODUCTION OF THE DRAWINGS

The invention will now be illustrated by way of a nonlimitative embodiment described below with reference to the drawings, in which:

FIG. 1 shows schematically a radial jet cell embodying the invention for use in the method embodying the invention, FIG. 2 is a cross-section of the slot of the cell of FIG. 1, FIG. 3 is a view corresponding to arrow III of FIG. 2, FIG. 4 is a graph with experimental results relating to the coating weight, and FIG. 5 is a graph giving a line of action of the method in accordance with the invention at optimum process efficiency.

DESCRIPTION OF THE PREFERRED EMBODIMENT

Figure 1:
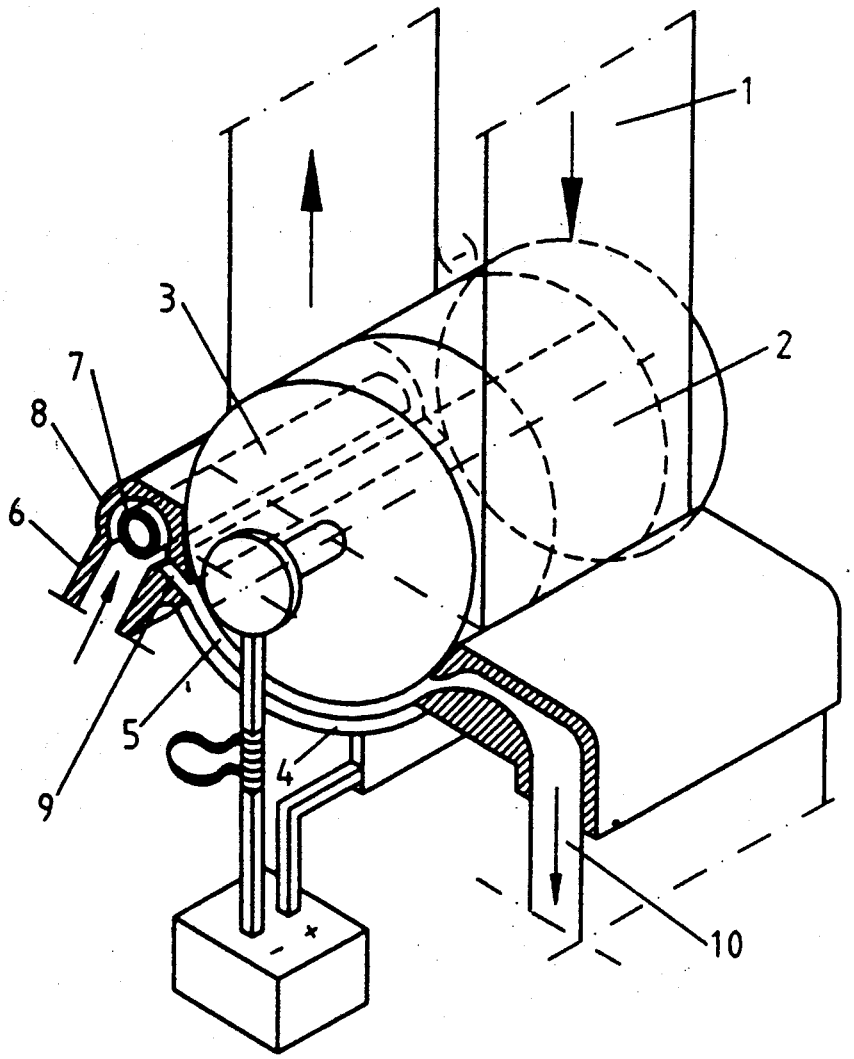

In the schematic drawing of the radial jet cell of FIG. 1 a metal strip 1 is shown which is in contact with an electrically conductive part 2 of the outer surface of a rotating cathode roller 3 as it is led through a slot 5 formed by the insoluble anode 4 concentric with the roller 3, in the direction indicated by arrows. The cathode roller 3 is connected to the negative terminal and the anode to the positive terminal of a source of rectified voltage. The electrolyte is fed at an acute angle $\alpha$ (see FIG. 2) into the slot 5 from a vessel 8 extending across the whole width of the strip 1 and provided with a central core body 7 through a slit-shaped converging nozzle 9 as a liquid jet distributed uniformly across the width of the strip at the strip exit end of the slot, in such a way that a tangential component is obtained opposite to the direction of travel of the strip. An average velocity in the gap is achieved such that turbulent flow occurs. The electrolyte is fed into the vessel 8 through four feed pipes 6 spaced across the width of the strip and out of line with the nozzle 9. The nozzle 9 has an outlet mouth of uniform width and open uninterruptedly across the width of the strip 1. After it has passed through the slot 5, the electrolyte is discharged through a duct 10, and then the metallic ion concentration in the electrolyte is brought back to the desired level (this is not shown in drawing) and finally the electrolyte is pumped again through the feed pipes 6.

Figure 2:
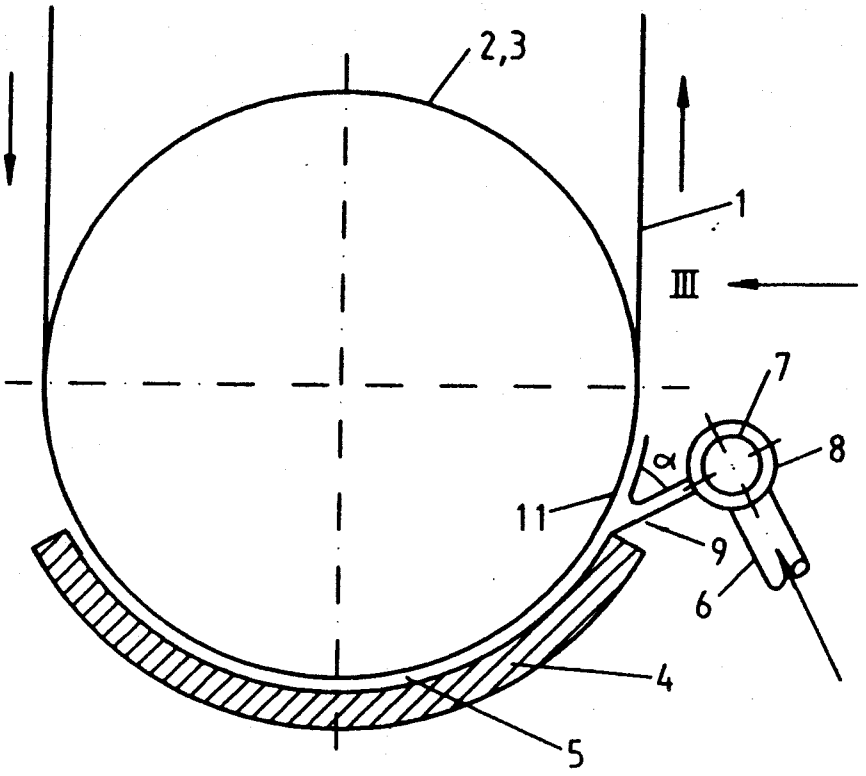
Figure 3:
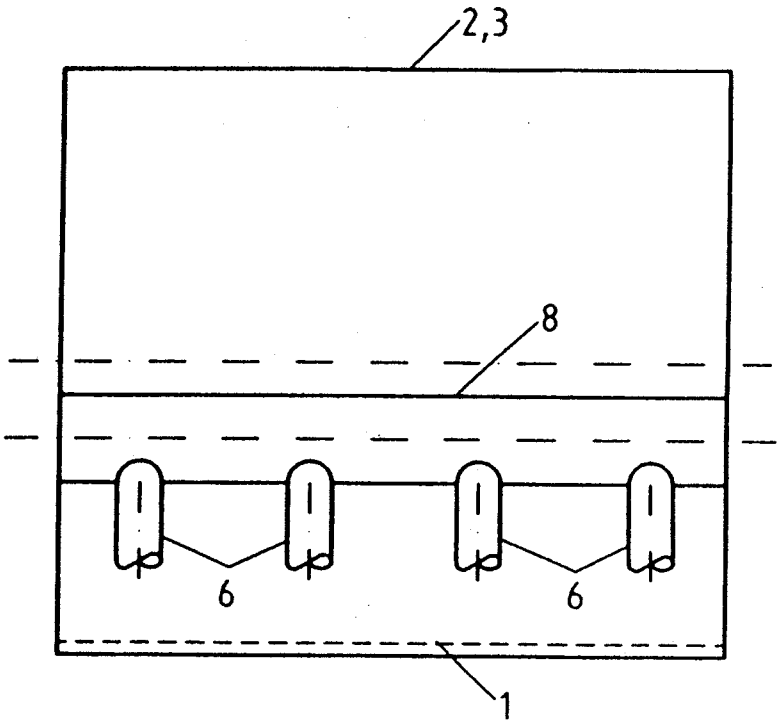

FIG. 2 shows that the pipes 6 are not aligned with the nozzle 9, but are at right angles to it. At the same time FIG. 2 shows that the nozzle 9 joins the slot 5 at an acute angle $\alpha$; the angle $\alpha$ shown is 30°. Furthermore, FIG. 2 shows that the volume of the vessel 8 is large compared with the volume of the nozzle 9. FIG. 2 also shows that the nozzle 9 is connected leak-free to the anode 4 at the exit end of the slot 5. Finally, FIG. 2 shows the exit opening 11 of the strip at the nozzle. In this, a small under pressure is generated through the nozzle because of the small angle $\alpha$, thus limiting leakage of the electrolyte through the exit opening.

Figure 4:
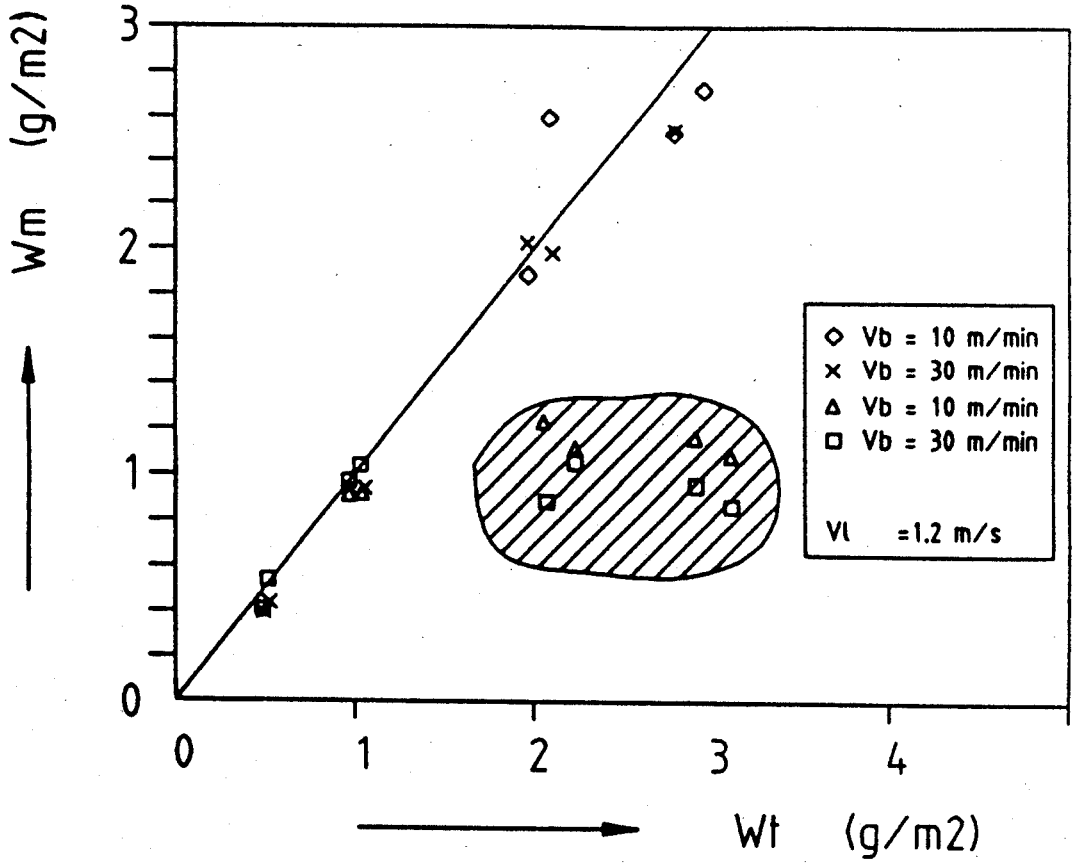

FIG. 4 shows some experimental results relating to the coating weight in tinplating. The graph gives vertically the recorded coating weight $W_m$ and horizontally the theoretical coating weight $W_t$. The results relate to trials in which the direction of flow of the electrolyte into the gap was the same as the direction of travel of the strip, that is to say as in the process of EP-A-125707, and using various combinations of strip and electrolyte velocities. It was found that with many combinations the recorded coating weight did not vary much from the theoretical coating weight which means that the efficiency of the coating process is high. However, with certain combinations (in the cross-hatched area) the recorded coating weight is much lower than the theoretical coating weight; there the efficiency of the coating weight is 50% and less. It was found that this low efficiency occurs with combinations in which the average velocity of the electrolyte $V_1$ is roughly as high as the strip velocity $V_b$, that is to say where $V_1/V_b$ is about 1, or in other words within the range set out in EP-A-125707.

It was found from these experimental results that the relative velocity of the electrolyte compared with the strip in an important parameter in the coating process and one which should not be too small. In the present invention, by selecting the direction of flow of the electrolyte a low relative velocity of the electrolyte is avoided.

Figure 5:
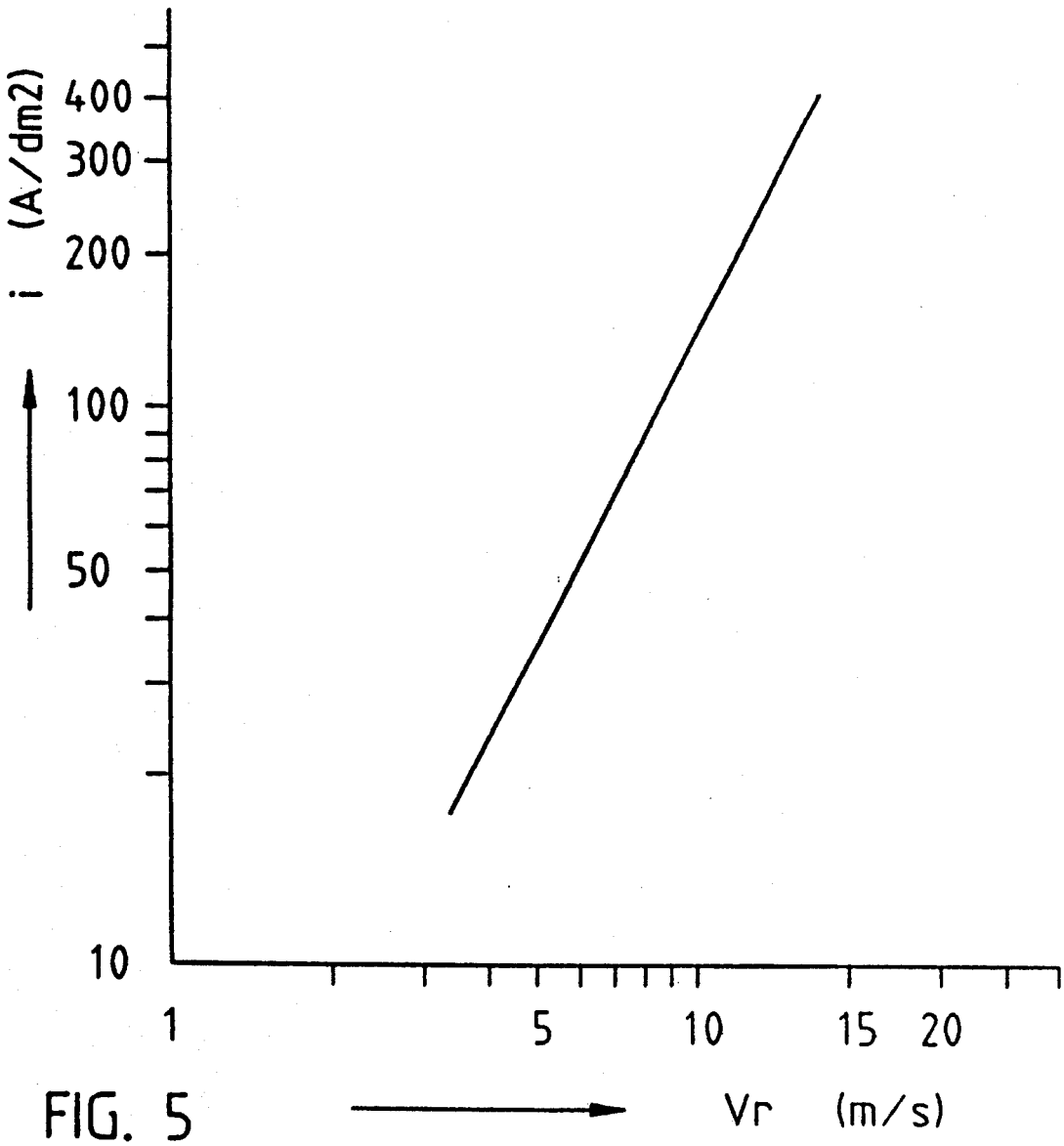

FIG. 5 shows a correlation of experimental results concerning the method in accordance with the invention in tinplating with a coating process efficiency of 95% and above under equal conditions of concentration and temperature of the electrolyte. It was found that there is a unique linear relationship between the applied electrical currency density i (vertical axis in the graph of FIG. 5) and the relative velocity $V_r$ of the electrolyte compared with the strip (horizontal axis).

The line drawn in the graph is a line of action for tinplating in accordance with the invention at an efficiency of 95% and above of steel strip with differing coating weights. Preference is given to the application of an average velocity of the electrolyte into the gap of at least 5 m/sec and, more preferably at least 7 m/sec. Using such a high relative velocity of the electrolyte means that the installation may be compact.

In the experiments described above, 850 mm wide steel strips were tinplated using the method in accordance with the invention with tin coating weights of between 0.5 and 2.8 g/m$^2$. In most cases it was found that the tin coating weight did not spread more than $+-0.04$ to $+-0.02$ g/m$^2$. When adopting the measures in the method in accordance with the invention a coated product is obtained with a coating layer which is very uniform and which has a good morphology.

What is claimed is:

1. Method of electrolytic coating of one side of a moving metal strip, comprising the steps of (a) passing the moving strip around a rotating roller having an insoluble anode extending concentrically therewith so that there is a circumferential slot between the anode and the strip, in which the electrolyte coating takes place, (b) supplying electrolyte from a plurality of sources to said slot at an end thereof at which the strip exits through a nozzle whose conformation is substantially uniform across the width of the strip in a larger volume relative to the volume of the nozzle and at a sufficient average velocity that turbulent flow occurs, said electrolyte being fed into said slot at a velocity which nowhere across the width of the strip deviates by more than 10% from said average velocity, and (c) applying electrical current to the strip as cathode and the anode so that electrolyte coating of the strip takes place in the slot.

2. Method in accordance with claim 1, wherein said average velocity of the electrolyte in the slot (5) is at least 5 m/sec.

3. Method in accordance with claim 2, wherein said average velocity of the electrolyte in the slot (5) is at least 7 m/sec.

4. Method in accordance with claim 1 wherein said electrolyte flow is rectangular in cross-section and extends across the whole width of the strip, said flow making an acute angle $\alpha$ of less than 45° with said slot.

5. Method in accordance with claim 1, wherein the discharge directions of said plurality of sources are not aligned with the nozzle.

6. Method in accordance with claim 1, wherein said vessel contains a core body.

7. Method in accordance with claim 4, wherein said acute angle $\alpha$ is approximately 30°.

8. Method in accordance with claim 1, said nozzle connects in an essentially leak-free manner to the anode at the strip exit end of the slot.

9. Apparatus for electrolytic coating of one side of a moving metal strip, comprising (a) a rotatable roller around which, in use, the moving strip passes, (b) an insoluble anode extending concentrically with said rotatable roller so that a circumferential slot is provided between the strip and the anode, said slot having circumferential ends at which the moving strip respectively enters and exits, (c) electrolyte feed means including a plurality of sources of electrolyte, a vessel connected to said sources, and a feed nozzle for the electrolyte at said strip exit end of said slot for causing electrolyte to flow generally circumferentially along said slot at an average velocity such that turbulent flow occurs, said nozzle having a substantially uniform conformation across the width of the strip, said vessel having a larger volume relative to the volume of the nozzle, said electrolyte feed means being adapted and arranged so that the electrolyte is fed into the slot at a velocity which nowhere deviates by more than 10% from said average velocity of the electrolyte, and (d) means for applying electrical current to the strip as cathode and said anode to cause electrolytic coating of the strip.

* * * * *